US007520290B2

(12) United States Patent
Dalbo

(10) Patent No.: US 7,520,290 B2
(45) Date of Patent: Apr. 21, 2009

(54) PORTABLE COLLAPSIBLE AWNING

(76) Inventor: Michele A. Dalbo, 217 Falcon Ct., Poughkeepsie, NY (US) 12603-3543

( * ) Notice: Subject to any disclaimer, the term of this patent is extended or adjusted under 35 U.S.C. 154(b) by 136 days.

(21) Appl. No.: 11/527,454

(22) Filed: Sep. 27, 2006

(65) Prior Publication Data

US 2007/0084491 A1 Apr. 19, 2007

Related U.S. Application Data

(60) Provisional application No. 60/727,516, filed on Oct. 18, 2005.

(51) Int. Cl.
*E04H 15/06* (2006.01)
*E04H 15/50* (2006.01)

(52) U.S. Cl. ..... 135/88.07; 135/145

(58) Field of Classification Search ..... 135/88.07, 135/88.12, 88.11, 88.13–88.18, 131, 128, 135/96, 143–147, 88, 120.3; 52/79.5, 109
See application file for complete search history.

(56) References Cited

U.S. PATENT DOCUMENTS

| | | | | |
|---|---|---|---|---|
| 1,128,558 | A | 2/1915 | Voorhies | |
| 2,470,337 | A | 5/1949 | Campbell | |
| 2,575,572 | A | 11/1951 | Wickstrum | |
| 2,698,629 | A | 1/1955 | Hall | |
| 2,799,286 | A | 7/1957 | Nordmeyer | |
| 2,828,757 | A | 4/1958 | Thaxton | |
| 3,064,667 | A * | 11/1962 | Marino | 135/131 |
| 3,092,126 | A | 6/1963 | Smith | |
| 3,131,705 | A | 5/1964 | Marino | |
| 3,266,503 | A | 8/1966 | Hoiness | |
| 3,534,511 | A | 10/1970 | Cappella | |
| 4,630,627 | A | 12/1986 | Windows | |
| D333,875 | S | 3/1993 | Jones | |
| 5,263,507 | A | 11/1993 | Chuang | |
| 5,269,359 | A * | 12/1993 | Pozzi | 160/46 |
| 5,331,777 | A | 7/1994 | Chi-Yuan | |
| 5,380,022 | A | 1/1995 | Dennis | |
| 5,575,301 | A | 11/1996 | Bolton | |
| 5,603,343 | A | 2/1997 | Larson | |
| 5,697,417 | A * | 12/1997 | Spoon | 160/71 |

(Continued)

FOREIGN PATENT DOCUMENTS

| | | |
|---|---|---|
| DE | 3721738 | 1/1988 |

(Continued)

*Primary Examiner*—David R Dunn
*Assistant Examiner*—Kaitlin A Wilson
(74) *Attorney, Agent, or Firm*—Richard C. Litman

(57) ABSTRACT

The portable collapsible awning provides a main collapsible frame structure for supporting a canopy, which is easily collapsible and portable, providing transportable protection from the elements. The main collapsible frame structure includes a plurality of vertical supports, which are each pivotally joined to one another by collapsible scissors-like crossbars. The vertical supports define a passageway for pedestrians, and are expandable and collapsible simultaneously in both the lateral and longitudinal directions. An auxiliary frame is further releasably attached at a proximal end to the main collapsible frame structure for supporting a walkway awning. The distal end of the auxiliary frame is adapted for overlying a portion of a roof of a vehicle, creating a covered walkway from the vehicle door to the user's destination without vertical supports or frame members intermediate the main canopy and the vehicle.

18 Claims, 6 Drawing Sheets

U.S. PATENT DOCUMENTS

| | | | | |
|---|---|---|---|---|
| 5,749,387 | A | 5/1998 | Thompson | |
| 5,839,462 | A | 11/1998 | Randall | |
| 5,967,162 | A | 10/1999 | Bolton | |
| 6,374,843 | B1 * | 4/2002 | Zou | 135/145 |
| 6,394,118 | B1 * | 5/2002 | Cikanowick et al. | 135/88.06 |
| 6,418,953 | B1 | 7/2002 | Novotny | |
| 6,550,491 | B1 * | 4/2003 | Bixler et al. | 135/145 |
| D486,242 | S | 2/2004 | Lin | |
| 6,763,633 | B2 | 7/2004 | Cote | |
| D506,240 | S | 6/2005 | Tseng | |
| 2002/0074032 | A1 | 6/2002 | Park | |
| 2002/0108647 | A1 * | 8/2002 | Chen et al. | 135/128 |
| 2003/0140577 | A1 | 7/2003 | Cote | |
| 2004/0035455 | A1 | 2/2004 | Pinnell | |
| 2004/0050412 | A1 * | 3/2004 | Dotterweich | 135/131 |
| 2004/0061026 | A1 | 4/2004 | Cordy | |
| 2004/0144414 | A1 | 7/2004 | Seo | |
| 2004/0173252 | A1 | 9/2004 | Bouchard | |
| 2005/0189005 | A1 * | 9/2005 | Smith et al. | 135/16 |
| 2005/0241688 | A1 * | 11/2005 | Wu | 135/145 |
| 2006/0032592 | A1 * | 2/2006 | Hicks et al. | 160/66 |
| 2006/0162755 | A1 * | 7/2006 | Platek et al. | 135/88.15 |

FOREIGN PATENT DOCUMENTS

| | | |
|---|---|---|
| EP | 0828044 A2 | 3/1998 |
| JP | 4182581 | 6/1992 |

* cited by examiner

PORTABLE COLLAPSIBLE AWNING

CROSS-REFERENCE TO RELATED APPLICATION

This application claims the benefit of U.S. Provisional Patent Application Ser. No. 60/727,516, filed Oct. 18, 2005.

BACKGROUND OF THE INVENTION

1. Field of the Invention

The present invention relates to portable sheltering structures similar to canopies, umbrellas, tents, etc., and particularly to a portable collapsible awning that includes a canopy and a walkway awning extending from the canopy, and further having an end adapted for resting on a vehicle roof to provide door-to-door protection when entering and exiting the vehicle.

2. Description of the Related Art

Covered walkways for protecting users from rain, snow and other inclement weather have been available in a wide variety of configurations for many years. Such walkways are typically in the form of a large umbrella or an awning that is fixed to a building or to the ground in a stationary manner. Although fixed awnings and umbrellas may be collapsed, they are not readily transportable.

Portable and collapsible covering systems have been utilized for a variety of purposes, and such systems typically include a plurality of support frame members joined together by cross bars, allowing the frame members to be collapsed and expanded in the longitudinal direction, similar in manner to an accordion. Such systems, however, are only collapsible in one direction and, thus, must be transported in a conveyance or vehicle that is at least as wide as the individual frame members. In order to make such a system easily transportable, the width of each frame member must be reduced, which does not allow the covering to serve a large group of people.

Further, such portable coverings are not adapted for use with a vehicle. If it is desired to provide protection from the vehicle's door to the user's destination, the frame must be positioned close to the door of the vehicle. The frame, however, would prevent the vehicle door from being fully opened. It would be desirable to provide a system allowing for the free opening of the vehicle door and providing a covered walkway from the door to the user's destination. Thus, a portable collapsible awning solving the aforementioned problems is desired.

SUMMARY OF THE INVENTION

The portable collapsible awning includes a main collapsible frame structure for supporting a canopy. The main collapsible frame is collapsible and portable, adapted for storage and transport in the trunk of a vehicle, and provides transportable protection from the elements. The main collapsible frame structure includes a plurality of vertical supports, which may be in the form of collapsible, telescoping rods. Each of the vertical supports is pivotally joined to one another by collapsible, scissors-like cross bars. The vertical supports define a canopy frame, and are expandable and collapsible simultaneously in both the lateral and longitudinal directions. A retractable wheel is provided on the lower end of each vertical support, allowing the main frame to be easily positioned with respect to the vehicle.

An auxiliary frame is further releasably attached at a proximal end to the main collapsible frame structure for supporting a walkway awning. The distal end of the auxiliary frame is adapted for releasable mounting on a roof of a vehicle, creating a covered walkway from the vehicle door to the canopy supported only at the ends of the walkway awning, which may be positioned adjacent a building entrance or other destination.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
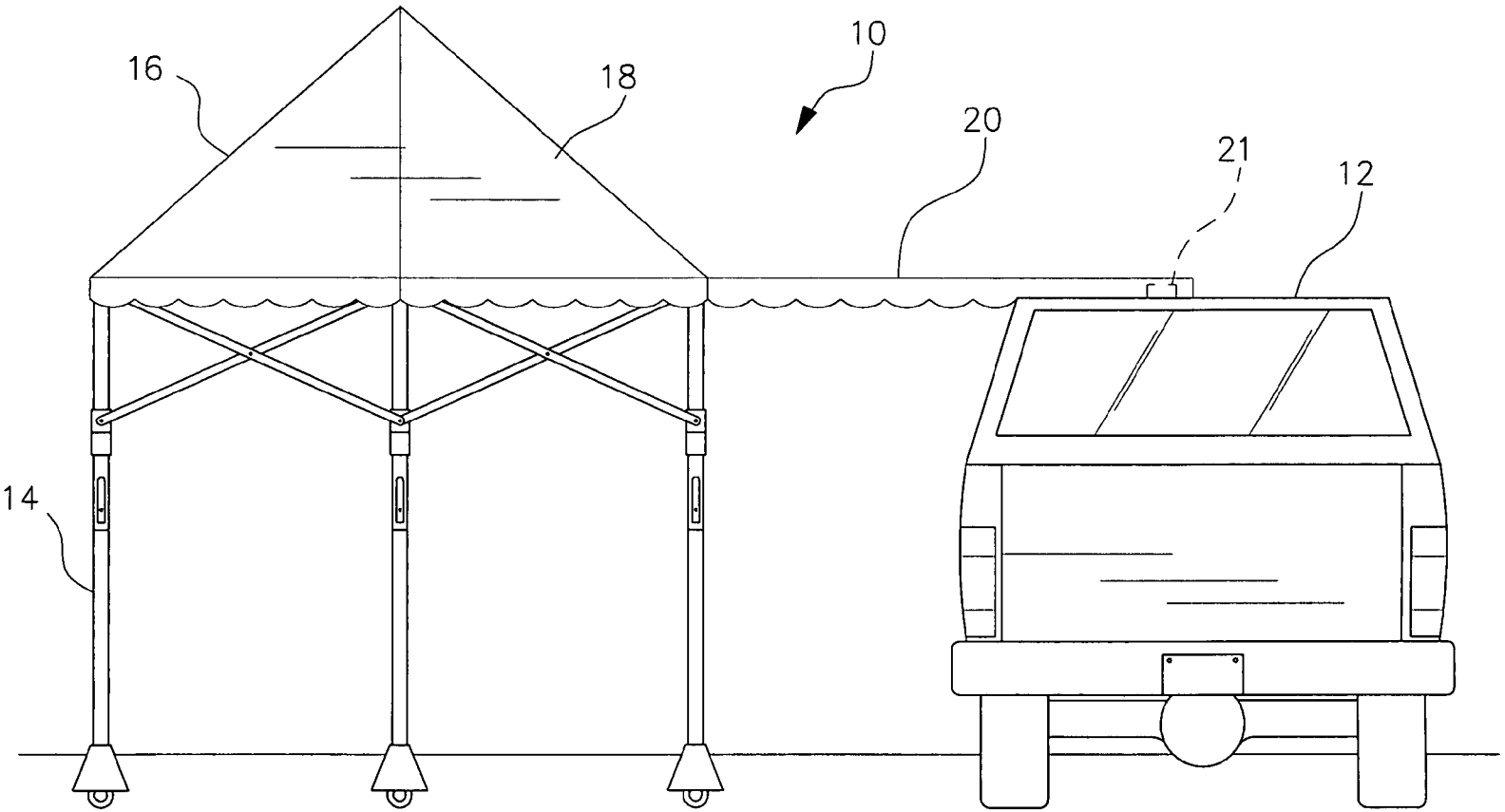
FIG. 1 is an environmental, side view of a portable collapsible awning according to the present invention.

Now referring to FIG. 1, there is shown a portable, collapsible awning, referred to generally as 10 in the drawings, providing easily transportable protection from the elements. Particularly, the portable collapsible awning 10 includes a main support frame 14 for supporting a main canopy, formed from first and second canopy sheets 16 and 18, and a walkway awning 20 extending from the main canopy, and which is supported on a removable frame, which will be described in further detail below.

As best shown in FIG. 1, a proximal end of walkway awning 20 is supported by the main support frame 14, and the distal end rests on the roof of vehicle 12, thus providing a covered walkway from the vehicle door to the user's destination while providing clearance for the opening of the vehicle door. Since the walkway awning 20 is only supported at its ends without any intermediate vertical columns or posts, the walkway awning 20 allows the main support frame 14 to be distanced apart from the vehicle, leaving ample space for the opening of the vehicle door, while providing a continuous covered walkway for the user. A magnet 21 or any other suitable means for releasable attachment may be mounted to awning 20, if desired, for securing the awning 20 to the roof of the vehicle. Preferably, magnet 21 is covered with cloth or other covering material for preventing scratches or other damage to the roof of the vehicle. The magnet 21 may be secured to the awning 20 by any suitable process, dependent upon the needs and desires of the user.

As will be described in further detail below, the main support frame 14 is collapsible in the vertical, lateral and longitudinal directions. Further, walkway awning 20 is removable from the main support frame 14. The nature of the collapsible awning 10 allows the awning 10 to be easily transported and set up both quickly and efficiently. When not in use, portable, collapsible awning 10 may be stored in the trunk of the vehicle 12, either on its own or in a separate container or bag. The portable, collapsible awning 10 may be manufactured in any size, depending upon the needs and desires of the user. In the preferred embodiment, the frame 14, in its expanded state, is approximately nine feet long in the lateral direction and approximately sixteen to eighteen feet long in the longitudinal direction, thus providing enough space for several people to fit underneath the awning 10.

Canopy sheets 16 and 18 and the walkway awning 20 are formed from lightweight, waterproof materials, such as canvas, nylon, vinyl, plastic or the like. Canopy sheets 16, 18 and walkway awning 20 may have indicia printed thereon, or may include decorative elements, such as the frill border shown in FIG. 1.

Figure 2:
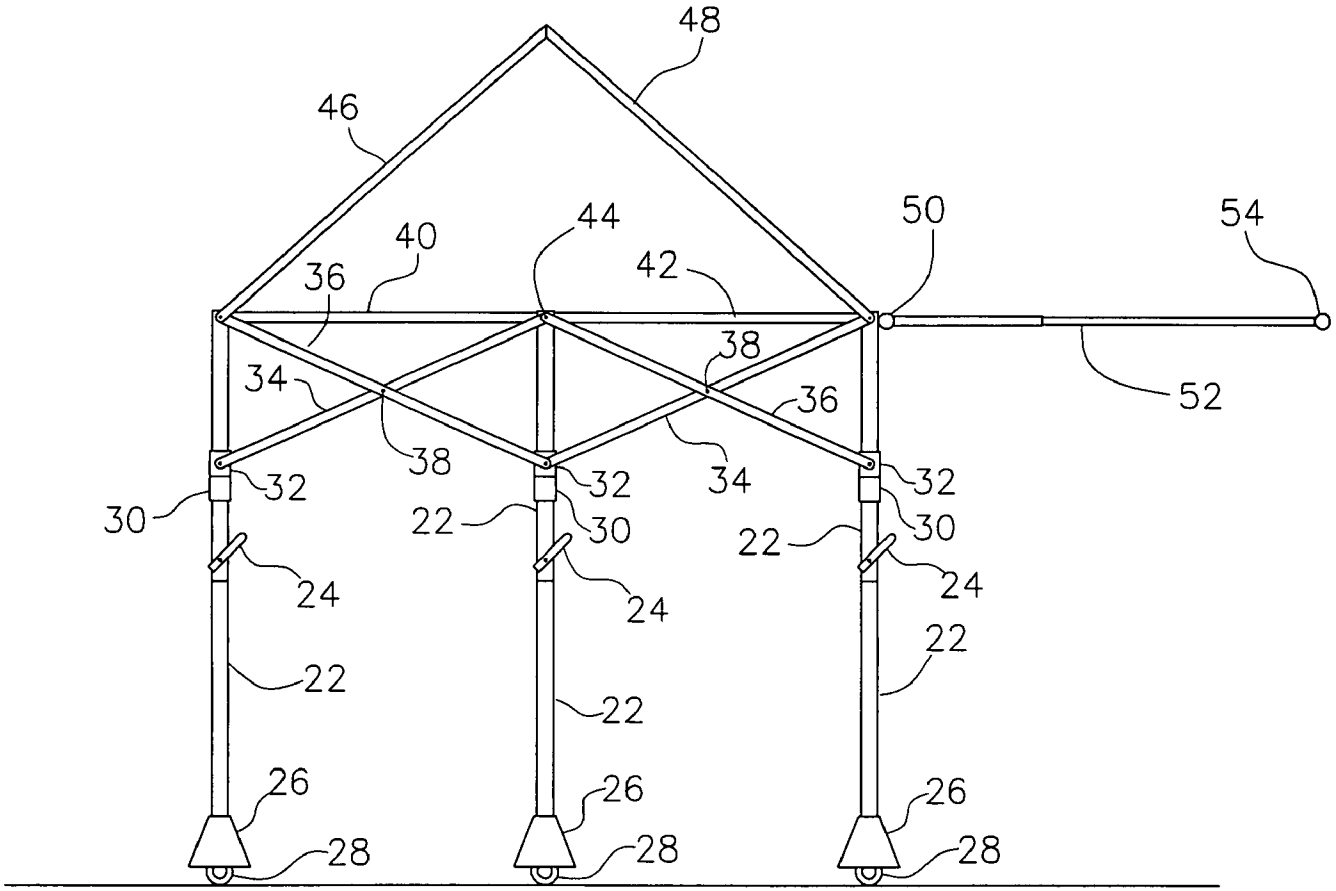
FIG. 2 is a side view of the internal frame structure of the portable collapsible awning of the present invention.
Figure 4:
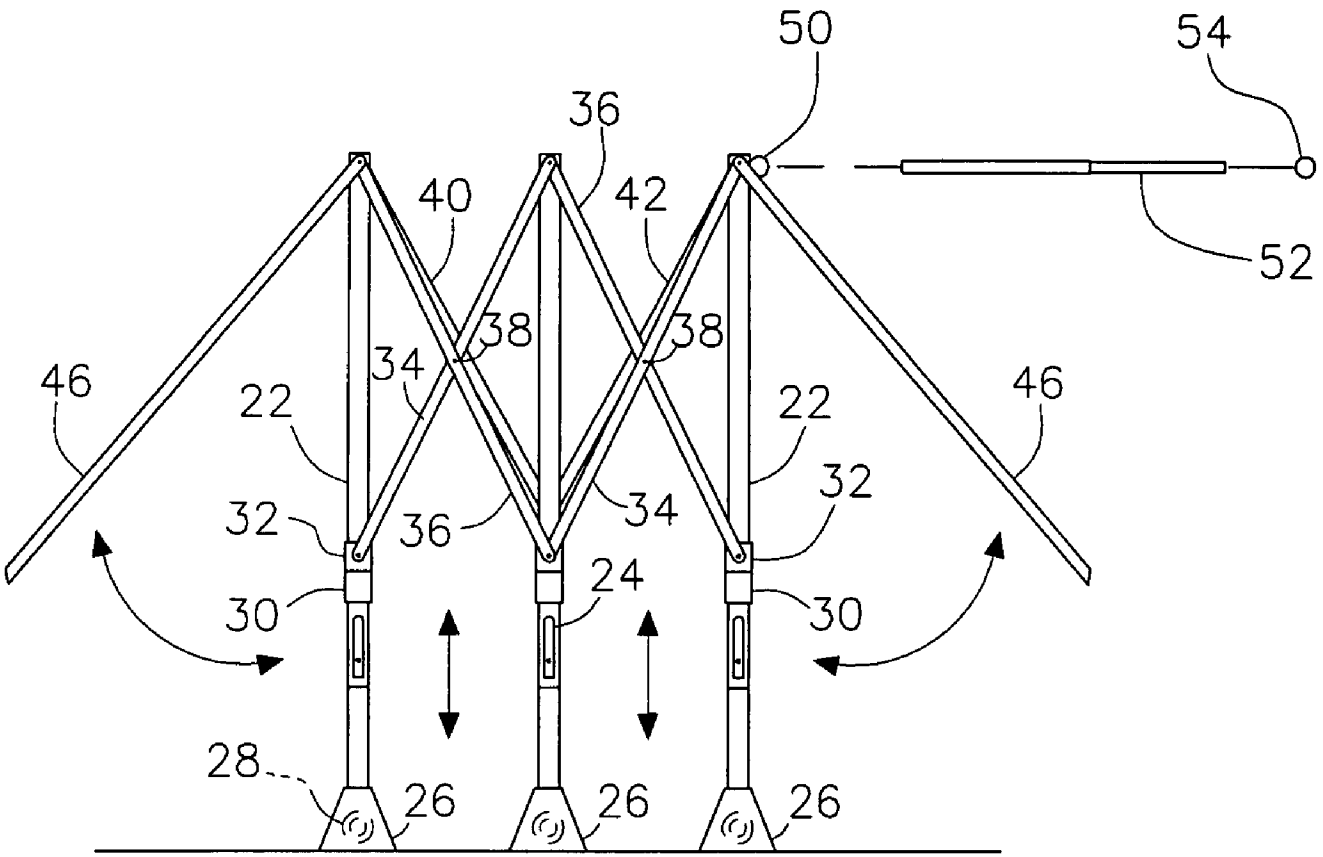
FIG. 4 is a partially exploded side view of the internal frame structure of the portable collapsible awning of the present invention in a partially collapsed state.

FIG. 2 shows the internal frame structure of the portable, collapsible canopy 10, without the canopy sheets 16, 18 or the walkway awning 20. The main frame structure is formed from a plurality of vertical supports 22, which may be telescoping rods, allowing for the collapse of awning 10 in the vertical direction, as will be described in further detail below. A wheel 28 is mounted on the lower end of each vertical support 22, allowing the support frame 14 to be selectively positioned and transported by the user. As best shown in FIG. 4, each wheel 28 is retractable within a respective wheel housing 26. The retraction of wheels 28 within wheel housings 26 allows the frame 14 to be stably positioned and, further, aids in the transport of awning 10 when awning 10 is in its collapsed state. Further, if desired, the assembled awning 10 can be moved by the users during use; i.e., the users could stand underneath the awning 10 and move the awning 10 as they walked, thus providing a mobile covering.

Figure 3B:
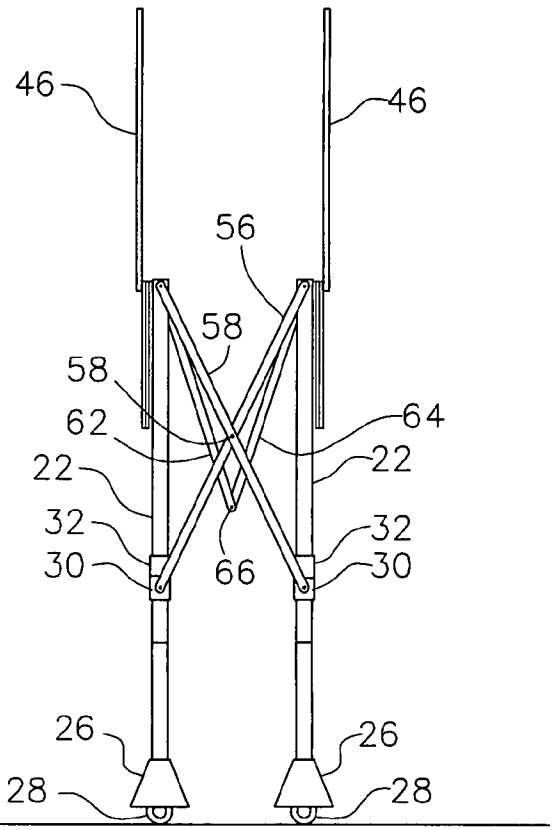
FIG. 3B is a front view of the internal frame structure of the portable collapsible awning of the present invention in a partially collapsed state.
Figure 3A:
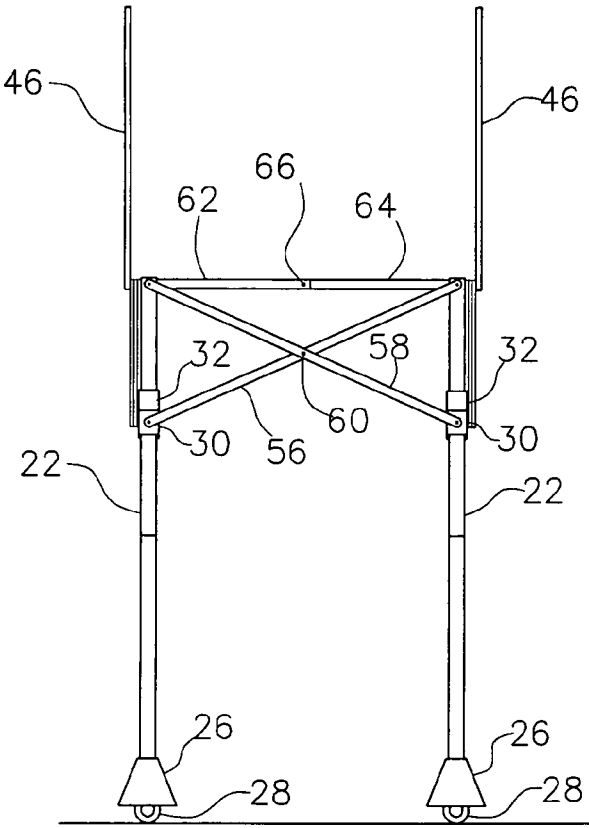
FIG. 3A is a front view of the internal frame structure of the portable collapsible awning of the present invention.

The structural elements of support frame 14, including vertical supports 22, are formed from lightweight, strong and non-corrosive materials, such as aluminum, plastic or the like. As best shown in FIG. 3A, the positioning of vertical supports 22 when main support frame 14 is in its expanded state defines a passage or walkway for the user.

Each vertical support 22 has a handle 24 pivotally joined thereto, providing hand grips for the user to position the awning 10. Each handle 24 may be pivoted back into a vertical storage position when not in use, as shown in FIG. 4.

Figure 7:
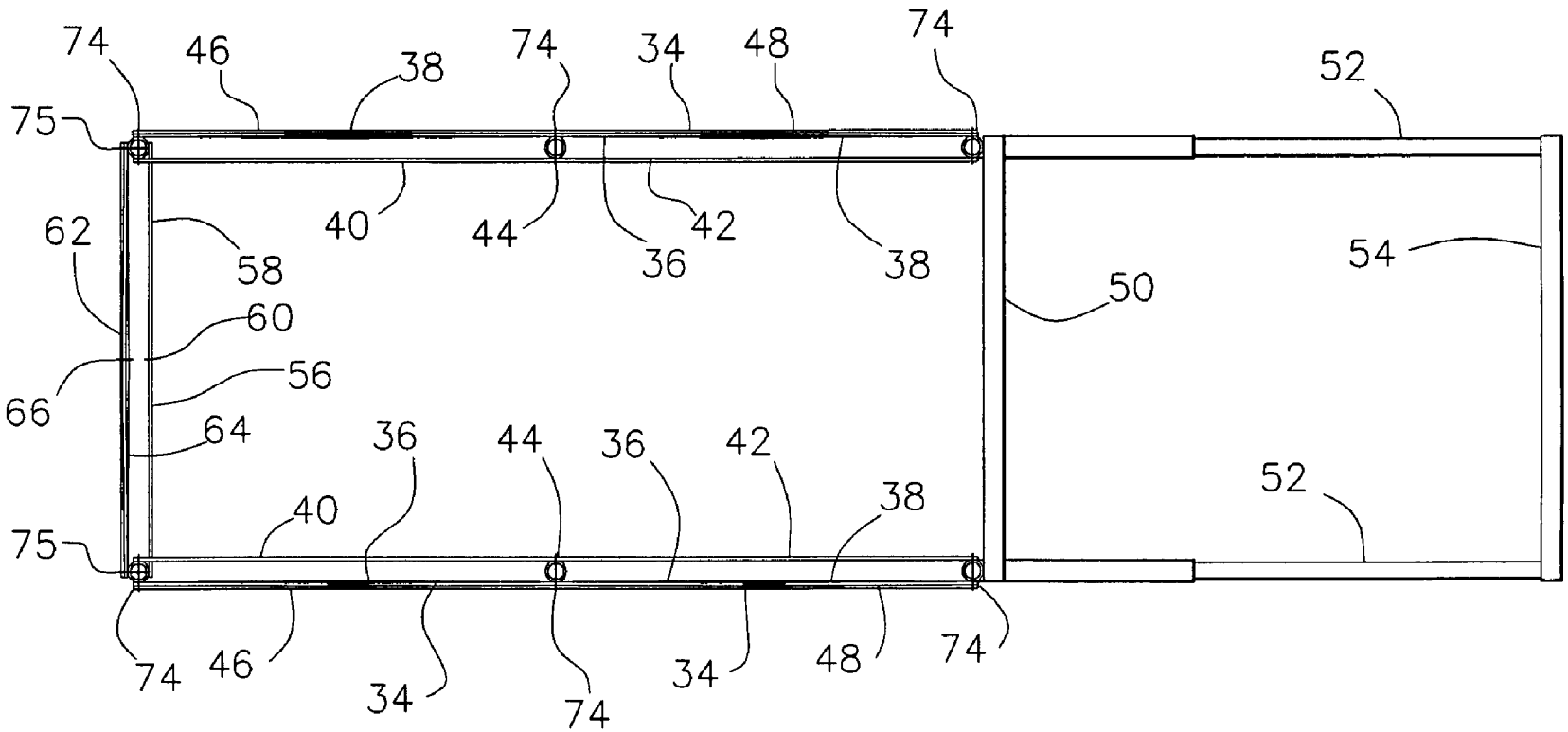
FIG. 7 is a top view of the internal frame structure of the portable collapsible awning according to the present invention.

As shown in the side view of FIG. 2 and the top view of FIG. 7, adjacent vertical supports 22 are joined to one another, in the longitudinal direction, by a pair of cross bars 34, 36. The upper ends of each cross bar 34, 36 are pivotally secured to the upper ends of vertical supports 22 by pivot pins 74. The lower ends of each cross bar 34, 36 are pivotally secured to sliding rings 32, which are slidably mounted on vertical supports 22.

Each cross bar 34 is pivotally joined at its center to a respective cross bar 36 by pivot pin 38, to form a pivoting, scissors-like connection. As best shown in the partially collapsed view of FIG. 4, the pivoting scissors-like interconnection of cross bars 34, 36 and the slidable mounting of sliding rings 32 allows the frame 14 to be easily collapsed and expanded in the longitudinal direction. Further, an upper horizontal support is mounted to the upper ends of vertical supports 22, extending in the longitudinal direction. As best shown in FIG. 2 and FIG. 7, each longitudinal support of frame 14 includes a pair of pivotally joined support bars 40, 42. The longitudinally opposed ends of support bars 40, 42 are pivotally secured to opposed vertical supports 22 by pivot pins 74, and support bars 40, 42 are pivotally joined to one another by pivot pin 44. As shown in FIG. 4, when the frame 14 is in a collapsed state, support bars 40, 42 pivot downwardly in order to conserve space, thus maintaining the transportable profile of frame 14.

As shown in the front view of FIG. 3A, the vertical supports 22 are joined to one another in the lateral direction in a similar manner to that described above with respect to the longitudinal direction. The upper ends of cross bars 56, 58 are pivotally joined to the upper ends of vertical supports 22 by pivot pins 75, similar to the pivotal connection of pivot pins 74, described above. Cross bars 56, 58 are joined to one another at their centers by pivot pin 60, pivotally joining cross bars 56, 58 in a scissors-like configuration.

The lower ends of cross bars 56, 58 are pivotally secured to sliding rings 30, which are mounted on vertical supports 22. As shown, sliding rings 30 are positioned below sliding rings 32 and, as illustrated in FIG. 3B and FIG. 4, sliding rings 30 and 32 move up and down on vertical supports 22 simultaneously, thus providing for the simultaneous expansion and collapse of frame 14 in both the longitudinal and lateral directions. This simultaneous collapse and expansion in both directions allows for the optimally efficient set up and collapse of the awning 10.

Similar to the longitudinal horizontal supports 40, 42 described above, a lateral horizontal support, formed from support bars 62, 64, is mounted on the upper ends of vertical supports 22 in the lateral direction. Support bars 62, 64 are pivotally mounted to vertical supports 22 at their opposed ends by pivot pins 75, and are pivotally joined to one another by pivot pin 66. As shown in FIG. 3B, in the collapsed state, support bars 62, 64 pivot downwardly, similar to the pivoting of support bars 40, 42, in order to minimize the size of frame 14 in its collapsed and portable state.

As best shown in FIG. 2, canopy supports 46, 48 are provided for supporting, respectively, canopy sheets 16, 18. Each canopy support is pivotally mounted to a vertical support 22 at its lower end by pivot pin 74. Canopy supports 46, 48 are not joined to one another. Each support 46, 48 has an upper edge contoured in such a manner that the upper edges abut one another, but are not fastened to one another, the supports 46, 48 forming a gabled or arched roof frame. This allows canopy supports 46, 48 to be pivoted downwardly, as shown in FIG. 4, when it is desired to place awning 10 in its collapsed state.

Figure 5:
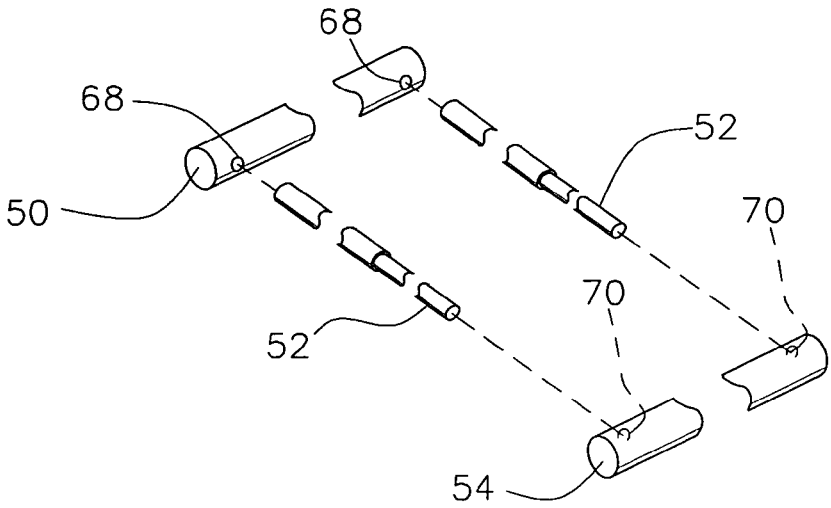
FIG. 5 is an exploded perspective view of an auxiliary frame structure of the portable collapsible awning according to the present invention.
Figure 6:
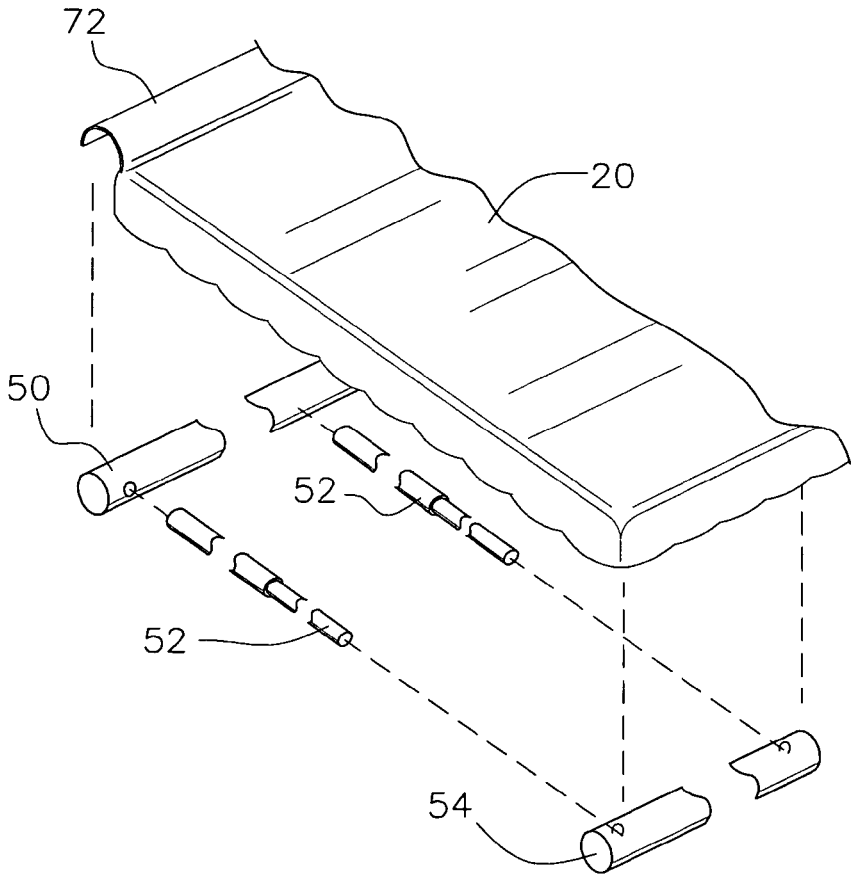
FIG. 6 is an exploded perspective view of the auxiliary frame structure an auxiliary canopy of the portable collapsible awning according to the present invention.

As best shown in FIGS. 5 and 6, walkway awning 20 is mounted on a pair of lateral supports 50, 54 and a pair of longitudinal supports 52. Lateral support 50 is mounted to the upper ends of vertical supports 22 opposite support bars 62, 64. The lateral support 50 is releasably mounted to support frame 14 through the use of hooks, latches or other suitable releasable fasteners. During collapse of awning 10, lateral support 50 is removed from frame 14, allowing for the collapse of the awning 10 and the separation and separate storage of walkway awning 20 and supports 52, 54.

As shown in FIG. 5, lateral support 50 includes a pair of recesses 68 for removably receiving the proximal ends of longitudinal supports 52. Similarly, lateral support 54 includes a matching pair of recesses 70 for receiving the distal ends of longitudinal supports 52. Each longitudinal support 52 may be a spring-loaded telescoping rod or tension rod, allowing for the efficient collapse and assembly of awning 10.

Lateral support 54 is permanently fixed to the distal end of walkway awning 20. As best seen in FIG. 7, the main frame forms a U-shaped configuration having an open mouth immediately below and to the left of lateral support 50. Thus, during disassembly lateral support 50, longitudinal supports 52 and the walkway awning 20 with the lateral support 54 are stored separately. In use, lateral support 54 rests on the roof of vehicle 12, as shown in FIG. 1. As shown in FIG. 6, a hook member 72 is formed on the proximal end of walkway awning 20, allowing for releasable engagement of walkway awning 20 with lateral support 50.

Walkway awning 20 with the lateral support 54, lateral support 50 and the longitudinal supports 52 are all separable and may be stored and transported separately, allowing for the quick and efficient assembly and knock-down of the awning 10. Frame 14 is, further, collapsible in the vertical, lateral and longitudinal directions, allowing for the efficient assembly and collapse of the entire awning 10, which may be easily transported and stored in, for example, the trunk of vehicle 12. The separate parts of the collapsed and disassembled awning 10 may, alternately, be stored in a bag or other storage container. The awning 10 provides a covered walkway from the vehicle door to the user's destination and is appropriate for use at weddings, proms, formal occasions, vehicle valet stations, funerals or any other event, locale or occasion where a covered walkway would be necessary or desired.

It is to be understood that the present invention is not limited to the embodiment described above, but encompasses any and all embodiments within the scope of the following claims.

I claim:

1. A portable collapsible awning, comprising:

a main collapsible frame, having:

a plurality of vertical support members, each of the vertical support members having an upper end and a lower end;

a respective retractable wheel mounted to the lower end of each vertical support member;

a plurality of collapsible horizontal members pivotally attached to the upper ends of the vertical supports, the horizontal members forming a U-shaped top frame having an open mouth when the horizontal members are extended; and a plurality of upper canopy support members pivotally attached to the upper ends of the vertical support members, the main collapsible frame defining a passageway for pedestrians when the horizontal members are extended;

a first canopy removably mounted on said plurality of upper canopy support members;

an auxiliary frame having a proximal beam removably attached to the upper ends of the vertical support members across the open mouth of the U-shaped frame, a pair of elongated extensible rods removably attached to and extending from opposite ends of the proximal beam, and a distal beam attached across opposing ends of the extensible rods, the distal beam being adapted for overlying a portion of a vehicle roof;

a second canopy mounted on the auxiliary frame to form a walkway awning;

an attachment device mounted to said second canopy for releasably securing an end of said second canopy to the vehicle roof; whereby the walkway awning is adapted for providing an overhead covering connecting the main canopy with the vehicle without frame members obstructing opening of a door of the vehicle.

2. The portable collapsible awning as recited in claim 1, wherein each of said wheels is retractable with respect to the respective vertical support member to which the wheel is mounted.

3. The portable collapsible awning as recited in claim 1, further comprising a plurality of wheel covers, each of said wheel covers being mounted to the lower end of a respective one said vertical support members, each said wheel cover covering a respective one of the wheels when the respective wheel is in a retracted position.

4. The portable collapsible awning as recited in claim 1, wherein each of said vertical support members comprises a telescoping rod.

5. The portable collapsible awning as recited in claim 1, wherein said plurality of collapsible horizontal members comprises a plurality of longitudinal horizontal members extending in a longitudinal direction, and a plurality of lateral horizontal members extending in a lateral direction.

6. The portable collapsible awning as recited in claim 5, wherein said plurality of longitudinal horizontal members includes at least one pair of longitudinal horizontal members, each of the pairs of longitudinal horizontal members including a first and a second longitudinal horizontal member, each of the first longitudinal horizontal members being pivotally joined to a respective one of the second longitudinal horizontal members.

7. The portable collapsible awning as recited in claim 6, wherein said plurality of lateral horizontal members includes at least one pair of lateral horizontal members, each of the pairs of lateral horizontal members including a first and a second lateral horizontal member, each of the first lateral horizontal members being pivotally joined to a respective one of the second lateral horizontal members.

8. The portable collapsible awning as recited in claim 1, further comprising a plurality of pairs of cross bars, each of the pairs of cross bars including a first cross bar and a second cross bar, each of the first cross bars being pivotally joined to a respective one of the second cross bars substantially centrally, each of the first and second cross bars having upper ends pivotally joined to a respective one of said vertical support members, each of the first and second cross bars having lower ends slidably mounted to an adjacent one of said vertical support members.

9. The portable collapsible awning as recited in claim 8, further comprising a plurality of sliding rings, each of the rings being slidably mounted to a respective one of said vertical support members, each of the lower ends of said first and second cross bars being pivotally joined to a respective one of the sliding rings.

10. The portable collapsible awning as recited in claim 9, wherein said plurality of pairs of cross bars includes a plurality of longitudinally extending pairs of cross bars and at least one laterally extending pair of cross bars.

11. The portable collapsible awning as recited in claim 1, further comprising a plurality of handle members, each of the handle members being attached to a respective one of said vertical support members.

12. The portable collapsible awning as recited in claim 11, wherein each said handle member is pivotally mounted to a respective one of said vertical support members.

13. The portable collapsible awning as recited in claim 1, wherein the distal beam of said auxiliary frame is removably attached to the pair of elongated extensible rods.

14. The portable collapsible awning as recited in claim 13, wherein the distal beam has a pair of recesses formed therein receiving distal ends of the pair of elongated extensible rods.

15. The portable collapsible awning as recited in claim 14, wherein the proximal beam has a pair of recesses formed therein receiving the proximal ends of the pair of elongated extensible rods.

16. The portable collapsible awning as recited in claim 1, wherein each said elongated extensible rod comprises a telescoping rod.

17. The portable collapsible awning as recited in claim 1, further comprising a hook member joined to a proximal end of the second canopy, the hook member releasably engaging the proximal beam of said auxiliary frame.

18. The portable collapsible awning as recited in claim 1, wherein said attachment device comprises a magnetic member.

* * * * *